US012025334B2

(12) United States Patent
Shan

(10) Patent No.: US 12,025,334 B2
(45) Date of Patent: Jul. 2, 2024

(54) SEALING MECHANISM, VENTILATION ASSEMBLY AND AIR-CONDITIONING APPARATUS

(71) Applicant: BEIJING XIAOMI MOBILE SOFTWARE CO., LTD., Beijing (CN)

(72) Inventor: Lianyu Shan, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 284 days.

(21) Appl. No.: 17/360,566

(22) Filed: Jun. 28, 2021

(65) Prior Publication Data

US 2022/0235963 A1 Jul. 28, 2022

(30) Foreign Application Priority Data

Jan. 25, 2021 (CN) ..... 202120200832.3

(51) Int. Cl.
*F24F 13/02* (2006.01)

(52) U.S. Cl.
CPC ..... *F24F 13/0209* (2013.01)

(58) Field of Classification Search
CPC ..... F24F 13/0209; F24F 7/013
USPC ..... 454/339
See application file for complete search history.

(56) References Cited

U.S. PATENT DOCUMENTS 2,011,419 A * 8/1935 Ross ..... F24F 7/013 454/208
2,373,496 A * 4/1945 Paiste, Jr. ..... F24F 7/007 415/149.1
5,105,868 A * 4/1992 Riise ..... E06B 7/32 160/90
6,241,600 B1 * 6/2001 Uehara ..... F24F 7/013 454/235
8,888,574 B2 * 11/2014 Bredahl ..... F24F 13/1413 454/339
10,520,206 B2 * 12/2019 Xu ..... F24F 13/12
11,536,485 B2 * 12/2022 Jang ..... F24F 13/0209

FOREIGN PATENT DOCUMENTS

WO WO 2013135036 A1 9/2013

OTHER PUBLICATIONS

European Patent Application No. 21182659.9, Search and Opinion dated Jan. 18, 2022, 7 pages.

* cited by examiner

*Primary Examiner* — Avinash A Savani
*Assistant Examiner* — Dana K Tighe
(74) *Attorney, Agent, or Firm* — COZEN O'CONNOR

(57) ABSTRACT

A sealing mechanism for an air-conditioning apparatus includes a fixed portion having an opening and a limiting rail; and a moving portion connected with the limiting rail and movable along the limiting rail to close or open the opening. At least one of the fixed portion and the moving portion is provided with a first sealing protrusion, and the first sealing protrusion is arranged between the fixed portion and the moving portion. The sealing mechanism may be used with a ventilation assembly of the air-conditioning apparatus.

11 Claims, 7 Drawing Sheets

SEALING MECHANISM, VENTILATION ASSEMBLY AND AIR-CONDITIONING APPARATUS

CROSS-REFERENCE TO RELATED APPLICATION

This application claims priority to Chinese Patent Application No. 202120200832.3, filed on Jan. 25, 2021, the entire content of which is incorporated herein by reference.

TECHNICAL FIELD

The present disclosure relates to a field of air-conditioning systems, and more particularly to a sealing mechanism, a ventilation assembly and an air-conditioning apparatus.

BACKGROUND

As living standard improves, requirements for indoor air quality are increasing, so an air-conditioning apparatus that works with fresh air has greater interest and appeal. In the related art, an air-conditioning apparatus has a ventilation assembly configured to provide the fresh air function of exchanging air between indoor and outdoor locations. When the air-conditioning apparatus with this type of ventilation assembly operates in an environment with a large temperature difference between indoor and outdoor, due to the poor sealing performance of the ventilation assembly, condensation often appears on the ventilation assembly, and drips to the floor and wall, thus damaging the indoor home environment and affecting the user experience.

SUMMARY

According to a first aspect of embodiments of the present disclosure, a sealing mechanism is provided and includes: a fixed portion having an opening and a limiting rail; and a moving portion connected with the limiting rail and movable along the limiting rail to close or open the opening. At least one of the fixed portion and the moving portion is provided with a first sealing protrusion, and the first sealing protrusion is arranged between the fixed portion and the moving portion.

According to a second aspect of embodiments of the present disclosure, a ventilation assembly is provided and includes: a volute having a first vent formed in a surface thereof; and a sealing mechanism arranged to the first vent and configured to seal the first vent. The sealing mechanism includes: a fixed portion having an opening and a limiting rail; and a moving portion connected with the limiting rail and movable along the limiting rail to close or open the opening. At least one of the fixed portion and the moving portion is provided with a first sealing protrusion, and the first sealing protrusion is arranged between the fixed portion and the moving portion.

According to a third aspect of embodiments of the present disclosure, an air-conditioning apparatus is provided and includes: a ventilation assembly; and a shell having a second vent, the ventilation assembly being arranged in the shell, and the first vent and the second vent being arranged corresponding to each other. At least one of the ventilation assembly and the shell is provided with a second sealing protrusion, and the second sealing protrusion is arranged between the ventilation assembly and the shell. The ventilation assembly includes: a volute having a first vent formed in a surface thereof; and a sealing mechanism arranged to the first vent and configured to seal the first vent. The sealing mechanism includes: a fixed portion having an opening and a limiting rail; and a moving portion connected with the limiting rail and movable along the limiting rail to close or open the opening. At least one of the fixed portion and the moving portion is provided with a first sealing protrusion, and the first sealing protrusion is arranged between the fixed portion and the moving portion.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to illustrative embodiments, examples of which are illustrated in the accompanying drawings. The following description refers to the accompanying drawings in which the same numbers in different drawings represent the same or similar elements, unless otherwise represented. The implementations set forth in the following description of illustrative embodiments do not represent all implementations consistent with the present disclosure. Instead, they are merely examples of apparatuses and methods consistent with aspects related to the present disclosure as recited in the appended claims.

The terms used in the present disclosure are merely for the purpose of describing specific embodiments, which are not intended to limit the present disclosure. As used in the descriptions and the appended claims of the present disclosure, "a," "said" and "the" in singular forms mean including plural forms, unless clearly indicated in the context otherwise. It should also be understood that, as used herein, the term "and/or" represents and contains any and all possible combinations of one or more associated listed items.

For an air-conditioning apparatus in a related art, take an air conditioner as an example, a ventilation assembly is arranged in an indoor unit of the air conditioner, and the ventilation assembly is connected to an outdoor air through a ventilation pipe. A fresh air channel in communication with outdoor and indoor is provided in the ventilation assembly, and the fresh air channel is in a closed state when the ventilation assembly is closed. When the temperature difference between the indoor and the outdoor is large (for example, the outdoor temperature is lower than −20° C.), since the ventilation assembly in the related art has poor sealing, the closure property is poor after the fresh air channel of the ventilation assembly is closed, especially at an air outlet. This results in an air leakage, that is, the outdoor air continuously enters the indoor. When a pressure difference between the indoor and the outdoor is not balanced, it is very easy to form condensation water. When the condensation situation gets worse, the condensation water forms droplets, which will drip to the user's indoor floor, and even flow to the wall to form water stains, thereby affecting the user experience.

Figure 1:
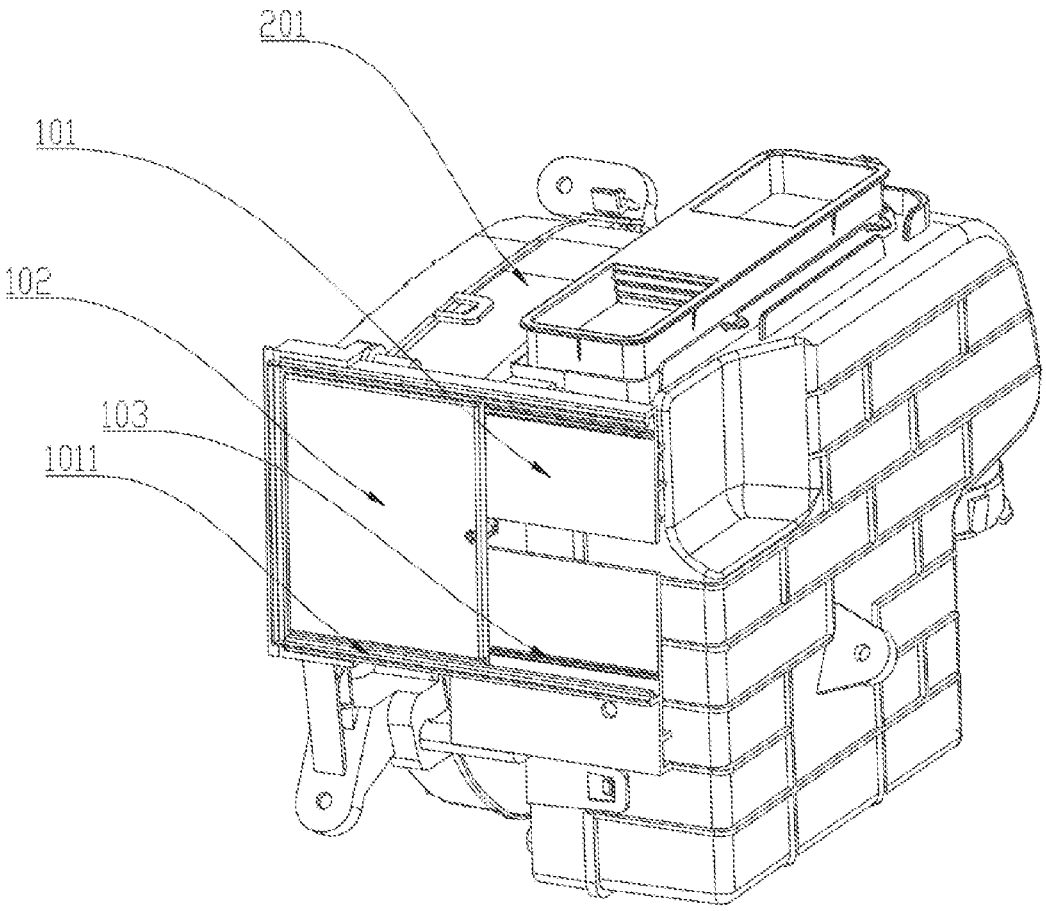
FIG. 1 is a schematic view of a sealing mechanism mounted to a ventilation assembly according to an illustrative embodiment of the present disclosure.
Figure 2:
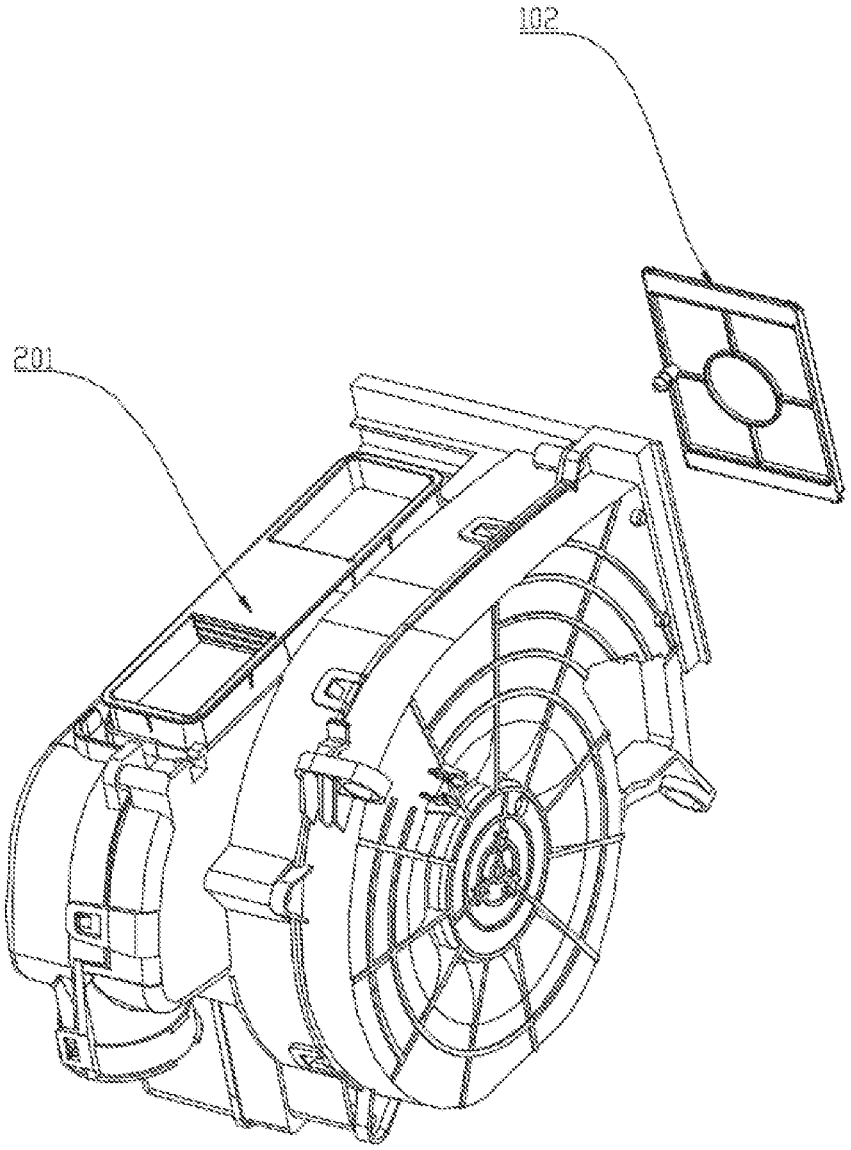
FIG. 2 is an exploded view of a sealing mechanism mounted to a ventilation assembly in a direction according to an illustrative embodiment of the present disclosure.
Figure 3:
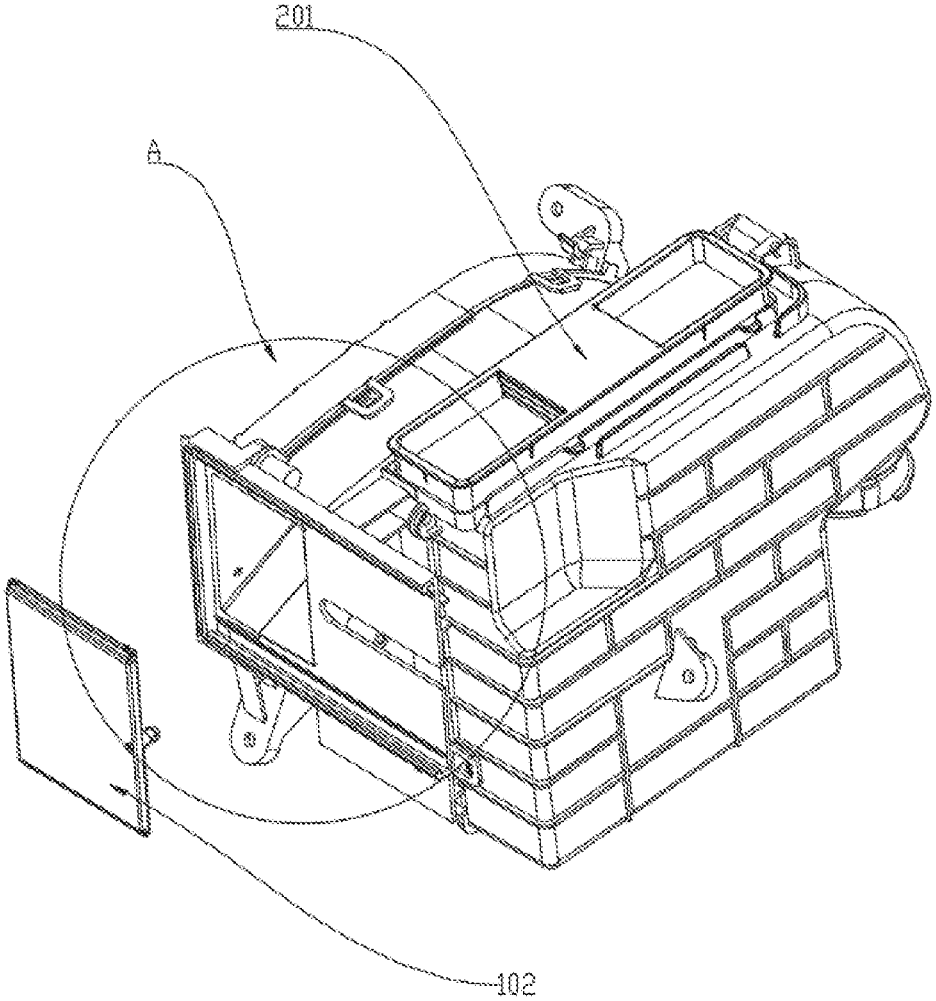
FIG. 3 is an exploded view of a sealing mechanism mounted to a ventilation assembly in another direction according to an illustrative embodiment of the present disclosure.
Figure 4:
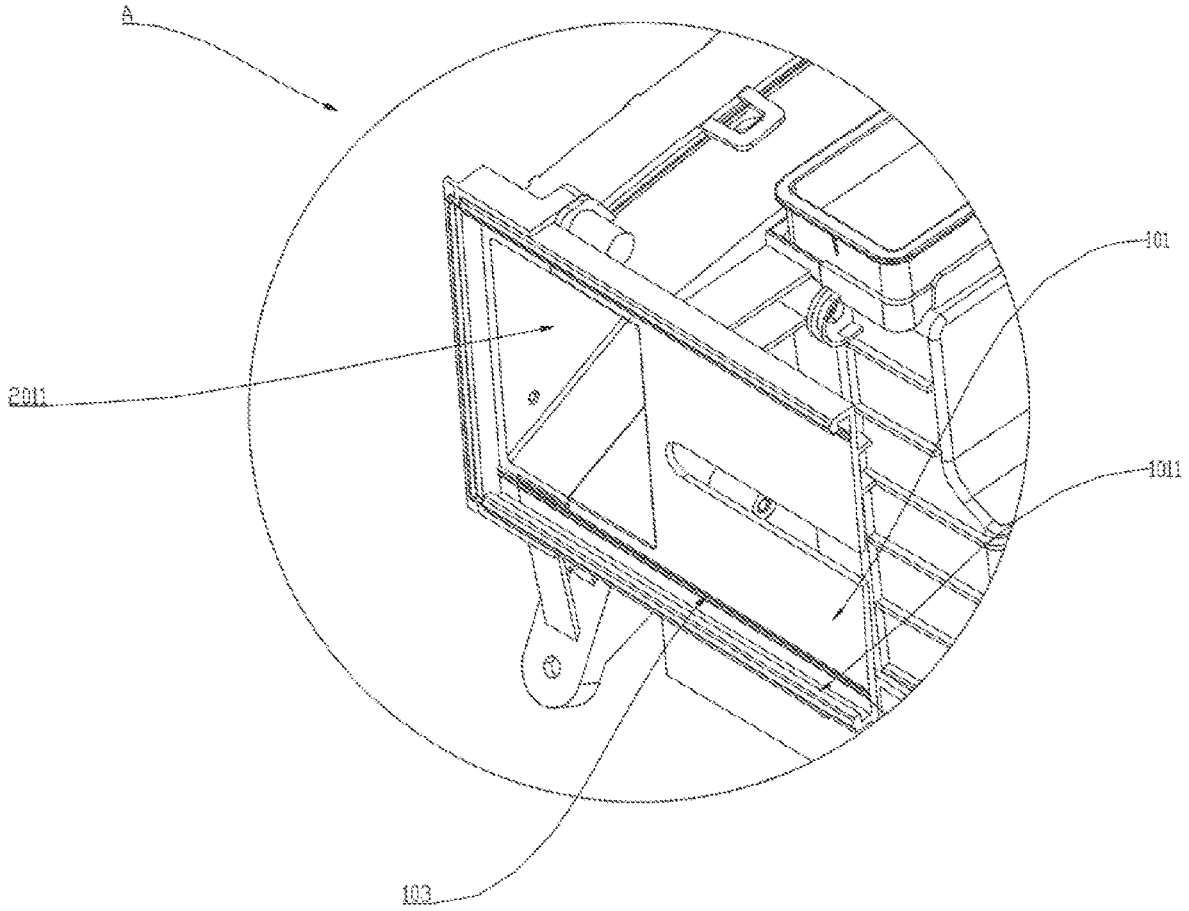
FIG. 4 is a partial enlarged view of part A in FIG. 3.
Figure 5:
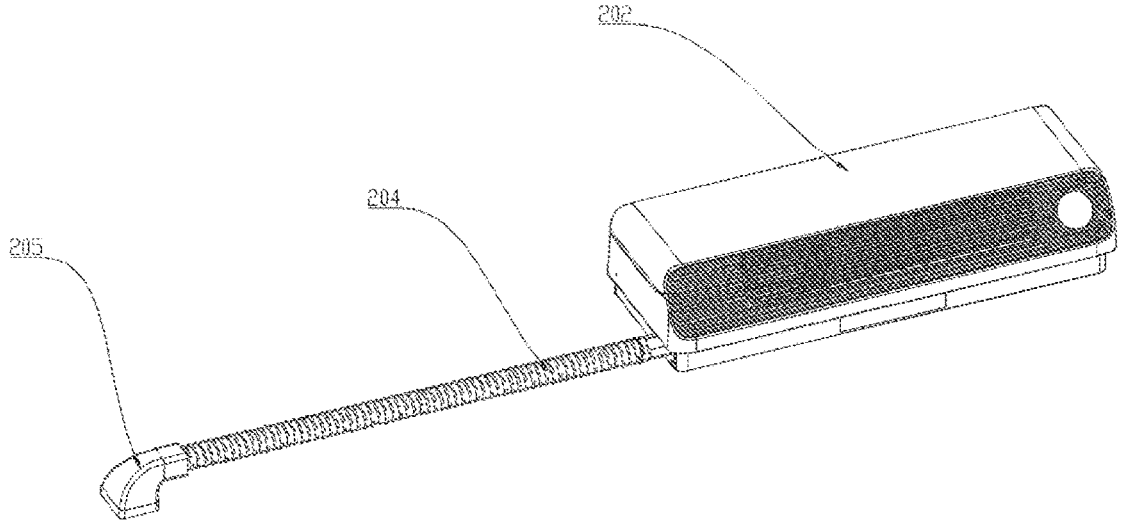
FIG. 5 is a schematic view of an air-conditioning apparatus in a direction according to an illustrative embodiment of the present disclosure.
Figure 6:
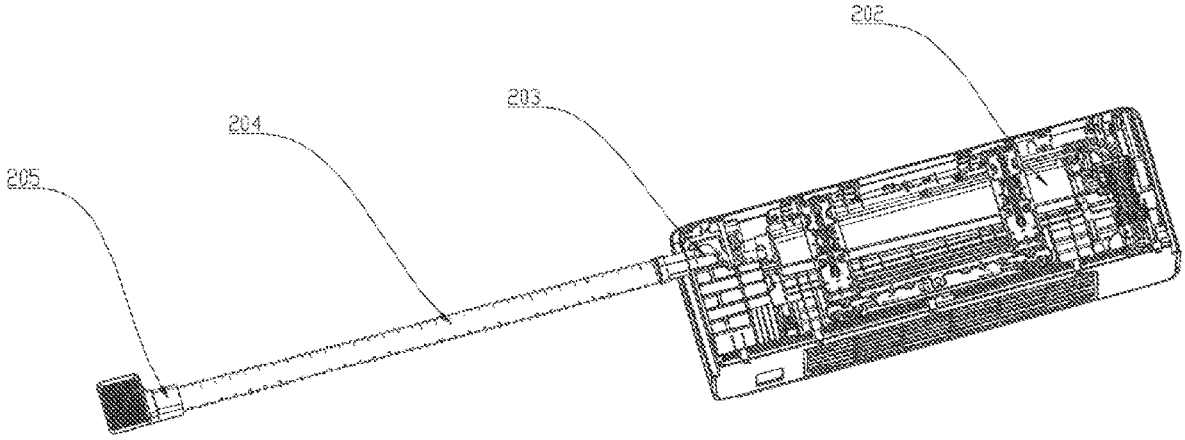
FIG. 6 is a schematic view of an air-conditioning apparatus in another direction according to an illustrative embodiment of the present disclosure.
Figure 7:
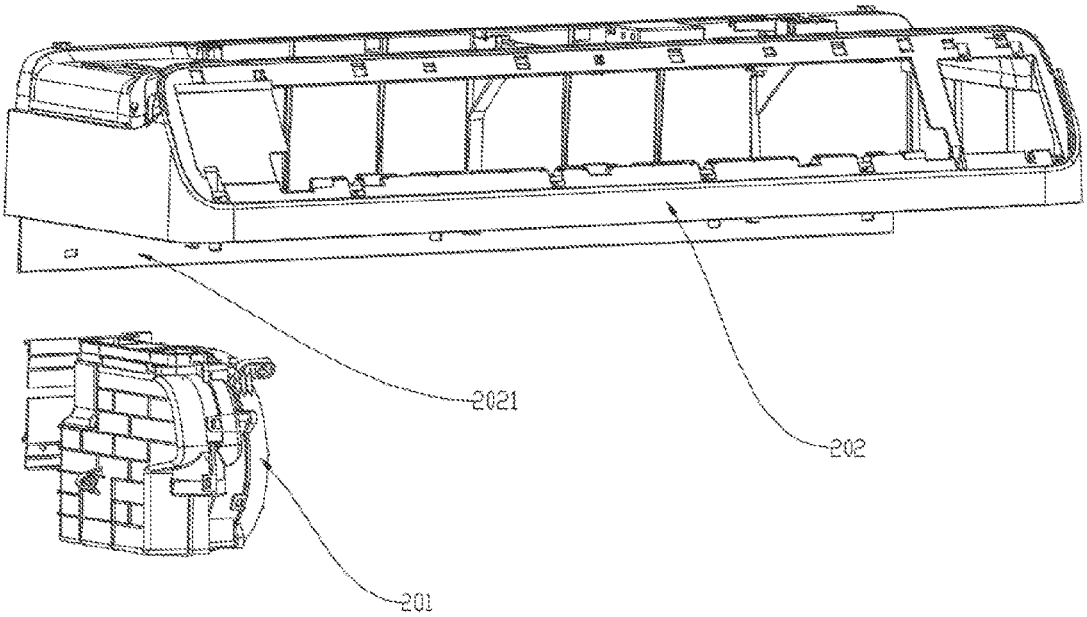
FIG. 7 is an exploded view of an air-conditioning apparatus in a direction according to an illustrative embodiment of the present disclosure.
Figure 8:
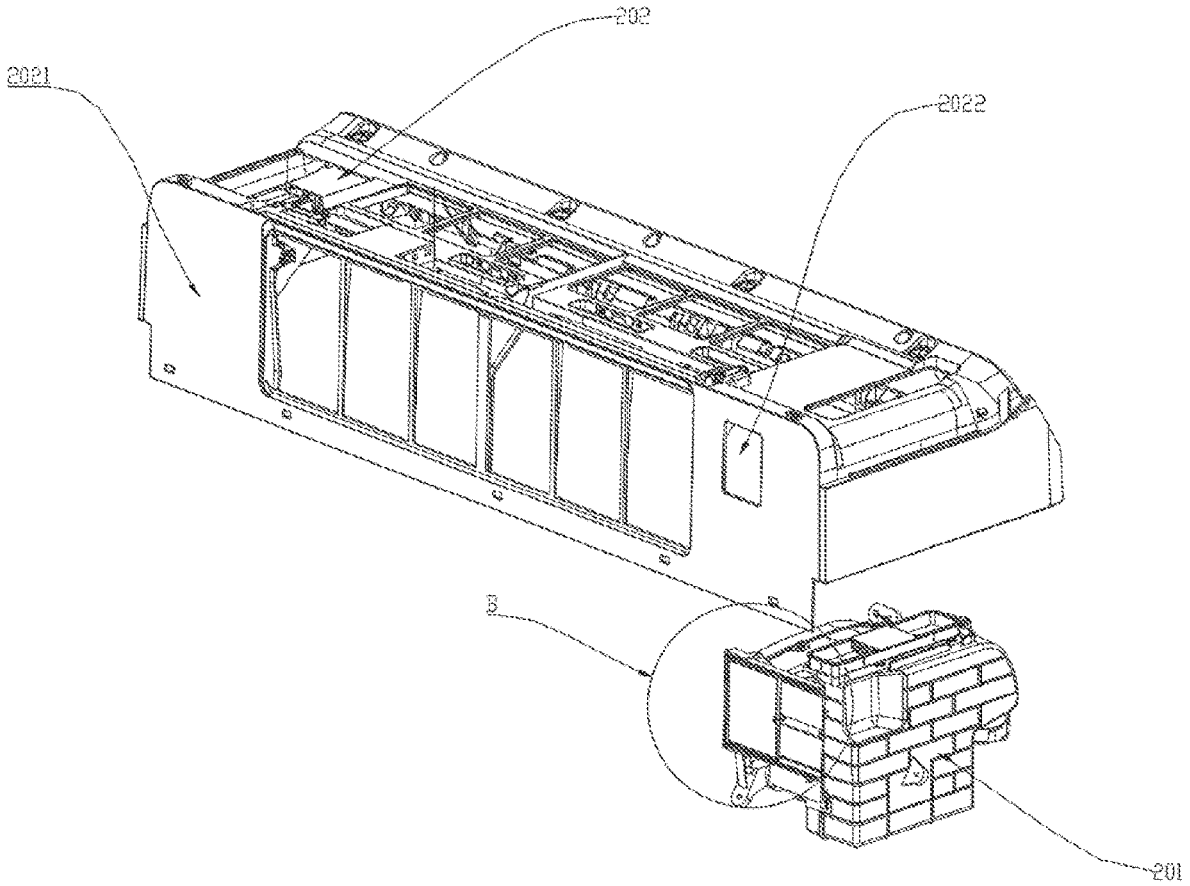
FIG. 8 is an exploded view of an air-conditioning apparatus in another direction according to an illustrative embodiment of the present disclosure.
Figure 9:
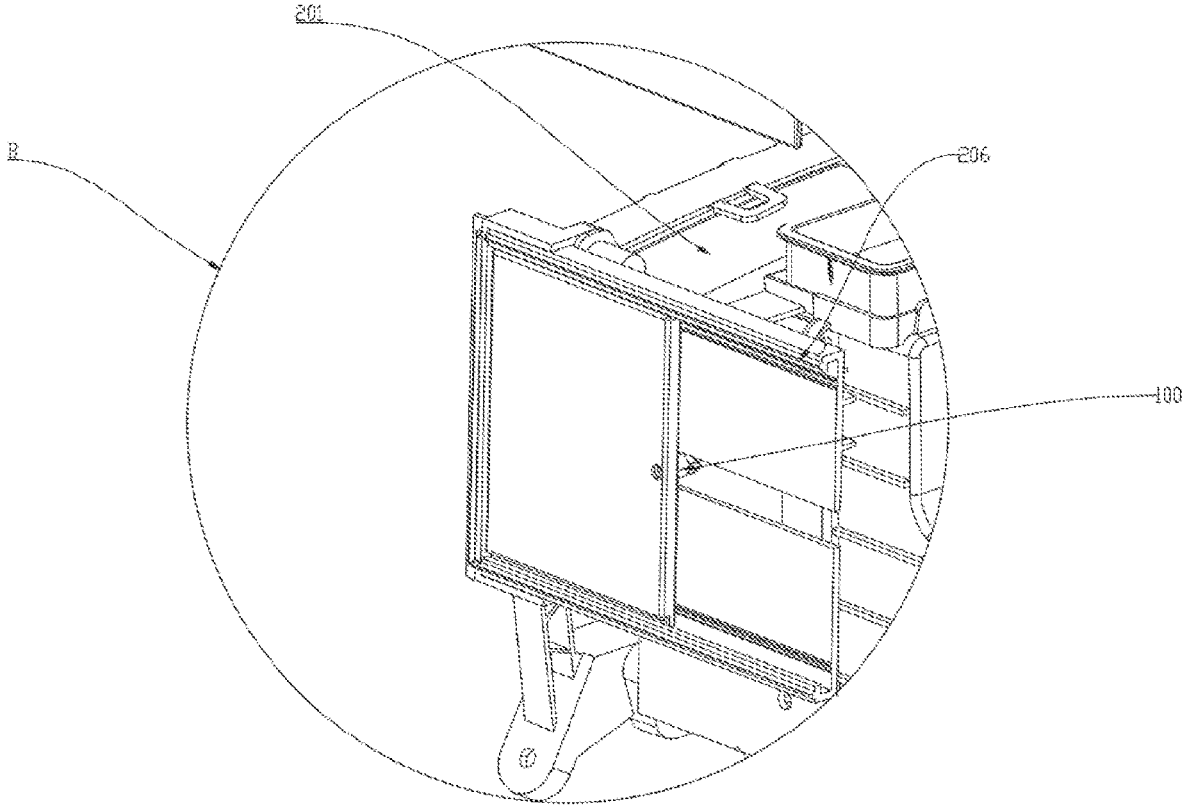
FIG. 9 is a partial enlarged view of part B in FIG. 8.

A sealing mechanism, a ventilation assembly and an air-conditioning apparatus provided as disclosed herein will be described in detail in combination with FIG. 1 to FIG. 9. FIG. 1 is a schematic view of a sealing mechanism mounted to a ventilation assembly according to an illustrative embodiment of the present disclosure; FIG. 2 is an exploded view of a sealing mechanism mounted to a ventilation assembly in an direction according to an illustrative embodiment of the present disclosure; FIG. 3 is an exploded view of a sealing mechanism mounted to a ventilation assembly in another direction according to an illustrative embodiment of the present disclosure; FIG. 4 is a partial enlarged view of part A in FIG. 3; FIG. 5 is a schematic view of an air-conditioning apparatus in a direction according to an illustrative embodiment of the present disclosure; FIG. 6 is a schematic view of an air-conditioning apparatus in another direction according to an illustrative embodiment of the present disclosure; FIG. 7 is an exploded view of an air-conditioning apparatus in a direction according to an illustrative embodiment of the present disclosure; FIG. 8 is an exploded view of an air-conditioning apparatus in another direction according to an illustrative embodiment of the present disclosure; FIG. 9 is a partial enlarged view of part B in FIG. 8.

At least one embodiment of the present disclosure provides a sealing mechanism, including: a fixed portion 101 having an opening and a limiting rail 1011; and a moving portion 102 connected with the limiting rail 1011, and movable along the limiting rail 1011 to close or open the opening. At least one of the fixed portion 101 and the moving portion 102 is provided with a first sealing protrusion 103, and the first sealing protrusion 103 is arranged between the fixed portion 101 and the moving portion 102.

The air-conditioning apparatus may be either a fresh air ventilator or an air conditioner with a fresh air function. The air-conditioning apparatus has a fresh air channel in communication with the outdoor and the indoor. An indoor end of the fresh air channel may be a ventilation assembly 201 (such as a volute, etc.) in the air-conditioning apparatus. The sealing mechanism may be applied to an air inlet and an air outlet of the fresh air channel, or a middle portion of the fresh air channel. The opening of the fixed portion 101 is adapted to a portion of the fresh air channel where the sealing mechanism is arranged, that is, the opening of the fixed portion 101 may be configured as an extension or a part of the fresh air channel.

The fixed portion 101 and the moving portion 102 may have a plate shape, and an area of the fixed portion 101 is larger than that of the moving portion 102. Both the fixed portion 101 and the moving portion 102 may have a rectangle or square shape, two long edges of the fixed portion 101 both form a crimping structure, the limiting rail 1011 is formed in the crimping structure, and two edges of the moving portion 102 are arranged in the two limiting rails 1011, respectively. Thus, the moving portion 102 is limited such that the moving portion 102 is unable to move in a direction of a short edge of the fixed portion 101, and is able to slide in a direction of the long edge of the moving portion 102. In addition, one short edge of the fixed portion 101 may also form a crimping structure, such that when the moving portion 102 is in a state of closing the opening, one edge of the moving portion 102 is in this crimping structure, so as to increase the sealing performance between the fixed portion 101 and the moving portion 102. Moreover, positioning of the moving portion 102 may be completed by limiting the sliding of the moving portion 102, that is, when the moving portion 102 slides to a point where it cannot slide anymore, the moving portion 102 has closed the opening, and the other short edge of the fixed portion 101 is reserved to be not crimped, so as to facilitate the assembling of the moving portion 102. Moreover, the moving portion 102 may be connected with a driving mechanism in the air-conditioning apparatus, such that the driving mechanism may drive the moving portion 102 to slide. The driving mechanism may run through the fixed portion 101 to be connected with the moving portion 102, and the portion which is run through position does not involve the fresh air channel, so the sealing performance of the fresh air channel will not be affected.

The first sealing protrusion 103 may have a rib shape, which may not only increase the sealing performance, but also avoid the processing difficulty or cost increase caused by too many protrusions. The first sealing protrusion 103 may be formed by deformation of the fixed portion 101 or the moving portion 102, or by increasing a thickness of a surface of the fixed portion 101 or the moving portion 102.

In an example, the first sealing protrusion 103 is provided on the fixed portion 101 and not provided on the moving portion 103, that is, the fixed portion 101 is provided with the first sealing protrusion 103 on at least one side of the opening.

In some embodiment, the fixed portion 101 is provided with the first sealing protrusion 103 on either side of the opening in a first direction, and the first sealing protrusion 103 extends along a second direction. The first direction is perpendicular to the second direction, and the limiting rail 1011 extends along the second direction. That is, two first sealing protrusions 103 parallel to the limiting rail 1011 are provided on the fixed portion 101, such that the first sealing protrusions 103 are closer to the opening than the limiting rail 1011, thereby preventing the sliding of the moving portion 102 in a limiting rail from affecting the closure property of the opening. For example, for the fixed portion 101 of the plate shape and the moving portion 102 of the plate shape, the two long edges of the fixed portion 101 are provided with the limiting rails, and one first sealing protrusion 103 parallel to the limiting rail is arranged between each limiting rail and the opening. The first sealing protrusion 103 parallel to the limiting rail 1011 is arranged to prevent the moving of the moving portion 102 from affecting the closure property of the sealing mechanism.

In some embodiment, the fixed portion 101 is provided with at least one annular first sealing protrusion 103 around the opening. The annular first sealing protrusion 103 may achieve the sealing between the fixed portion 101 and the moving portion 102 when the opening is in a closed state, thereby further improving the sealing performance of the sealing mechanism. Moreover, a plurality of annular first sealing protrusions 103 may realize a multi-layer sealing and hence further improve the sealing performance of the sealing mechanism.

In another example, the moving portion 102 is provided with at least one annular first sealing protrusion 103, and when the moving portion 102 is in the state of closing the opening, the at least one annular first sealing protrusion 103 surrounds the opening. The annular first sealing protrusion 103 may achieve the sealing between the fixed portion 101 and the moving portion 102 when the opening is in the closed state, thereby further improving the sealing performance of the sealing mechanism. Moreover, a plurality of annular first sealing protrusions 103 may realize a multi-layer sealing and hence further improve the sealing performance of the sealing mechanism.

In yet another example, the moving portion 102 is provided with at least one first sealing protrusion 103, and the fixed portion 101 is provided with at least one first sealing protrusion 103. When the moving portion 102 is in the state of closing the opening, the first sealing protrusion 103 of the moving portion 102 and the first sealing protrusion 103 of the fixed portion 101 form at least one annular protrusion. An annular sealing is realized by the cooperation of the moving portion 102 and the fixed portion 101, which may further improve the sealing effect. Moreover, the first annular protrusions are arranged to the moving portion 102 and the fixed portion 101, respectively, which may reduce the processing difficulty of the moving portion 102 and the fixed portion 101.

In the sealing mechanism provided by the present disclosure, the fixed portion 101 and the moving portion 102 are connected with each other by the limiting rail 1011, the moving portion 102 can move along the limiting rail 1011 relative to the fixed portion 101, and the opening of the fixed portion 101 can be opened and closed during the movement of the moving portion 102. Moreover, the first sealing protrusion 103 is arranged between the fixed portion 101 and the moving portion 102, so as to further improve the tightness between the fixed portion 101 and the moving portion 102, and also improve the closure property of the opening when the opening is closed. Therefore, after the sealing mechanism is applied to the air-conditioning apparatus, the closure property of the fresh air channel can be improved after the opening is closed, so as to prevent the problems of air leakage and condensation of the air-conditioning apparatus caused by the poor closure property of the fresh air channel.

In some embodiments of the present disclosure, a top end of the first sealing protrusion 103 is provided with a first elastic sealing piece. The top end of the first sealing protrusion 103 includes an end away from the fixed portion 101 or the moving portion 102 to which the first sealing protrusion 103 belongs.

The first elastic sealing piece may be made of sponge, rubber or flannel. Through the first elastic sealing piece arranged to the top end of the first seal protrusion 103, the sealing performance between the moving portion 102 and the fixed portion 101 may be further improved, thus further avoiding the problems of air leakage or condensation of the air-conditioning apparatus using the sealing mechanism.

At least one embodiment of the present disclosure also provides an air-conditioning apparatus, including a ventilation assembly 201 and the sealing mechanism 100 according to the embodiment of the present disclosure. The sealing mechanism 100 is arranged to a first vent 2011 of the ventilation assembly 201.

The air-conditioning apparatus includes a main body, such as an inner unit of the air conditioner or the fresh air ventilator, etc. The ventilation assembly 201 (such as a volute, etc.) is arranged in the air-conditioning apparatus. An air inlet of the ventilation assembly 201 is connected with one end of an air input pipe 204 through a connecting pipe 203, the other end of the air input pipe 204 extends from the indoor to the outdoor, and the other end of the air input pipe 204 may also be provided with a windshield cap 205. Thus, the windshield cap 205, the air input pipe 204, the connecting pipe 203 and the ventilation assembly 201 may form the fresh air channel. The fresh air channel may be further provided with an airflow driving device therein, such as a circulating pump, to drive the air to flow.

The fixed portion 101 of the sealing mechanism may be fixedly connected with the first vent 2011 of the ventilation assembly 201, or the fixed portion 101 of the sealing mechanism may also be integrally formed with the first vent 2011 of the ventilation assembly 201, so as to further enhance the sealing performance between the first vent 2011 and the sealing mechanism.

In some embodiments of the present disclosure, the air-conditioning apparatus further includes a shell 202 having a second vent 2022, the ventilation assembly 201 is arranged in the shell 202, and the first vent 2011 and the second vent 2022 are arranged corresponding to each other. At least one of the ventilation assembly 201 and the shell 202 is provided with a second sealing protrusion 206, and the second sealing protrusion 206 is arranged between the ventilation assembly 201 and the shell 202.

The shell 202 is provided with a face frame 2021, and the second vent 2022 may be formed in the face frame 2021. The first vent 2011 and the second vent 2022 may be completely identical and aligned with each other. The first vent 2011 may also be smaller than the second vent 2022, and the first vent 2011 is arranged in the second vent 2022. The second vent 2022 extends the fresh air channel of the ventilation assembly 201. Through the second sealing protrusion 206 arranged between the ventilation assembly 201 and the shell 202, the tightness of the fresh air channel may be ensured while the fresh air channel is extended, so as to improve the closure property when the fresh air channel of the ventilation assembly 201 is closed, thus preventing the problems of air leakage and condensation.

In an example, the second sealing protrusion 206 is arranged to surround the first vent 2011 and the second vent 2022. The second sealing protrusion 206 arranged to surround the first vent 2011 and the second vent 2022 may improve the sealing performance between the first vent 2011 and the second vent 2022, so as to prevent the outdoor air from entering an interior of the air-conditioning apparatus through the first vent 2011, which otherwise will pollute and damage the apparatus, or affect the operation of the apparatus.

In some embodiment, the ventilation assembly 201 is provided with at least one annular second sealing protrusion 206 around the first vent 2011 and the second vent 2022. In some embodiment, an inner surface of the face frame 2021 of the shell 202 is provided with at least one annular second sealing protrusion 206 around the first vent 2011 and the second vent 2022. In some embodiment, the ventilation assembly 201 is provided with at least one second sealing protrusion 206, and the inner surface of the face frame 2021 of the shell 202 is provided with at least one second sealing protrusion 206, such that the second sealing protrusion 206 of the ventilation assembly 201 and the second sealing protrusion 206 of the shell 202 form at least one annular protrusion surrounding the first vent 2011 and the second vent 2022.

In some embodiments of the present disclosure, a top end of the second sealing protrusion 206 is provided with a second elastic sealing piece. The top end of the second sealing protrusion 206 includes an end away from the shell 202 or the ventilation assembly 201 to which the second sealing protrusion 206 belongs.

The second elastic sealing piece may be made of sponge, rubber or flannel. Through the second elastic sealing piece arranged to the top end of the second sealing protrusion 206, the sealing performance between the ventilation assembly 201 and the shell 202 may be further enhanced, thus further avoiding the problems of air leakage or condensation of the air-conditioning apparatus.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as illustrative only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. An air-conditioning apparatus, comprising:

a ventilation assembly comprising:

a volute having a first vent formed in a surface thereof; and a sealing mechanism arranged to the first vent and configured to seal the first vent, the sealing mechanism comprising:

a fixed portion having an opening and a limiting rail; and a moving portion arranged on a side of the fixed portion facing away from the volute, connected with the limiting rail and movable along the limiting rail to close or open the opening, wherein at least one of the fixed portion and the moving portion is provided with a first sealing protrusion, and the first sealing protrusion is arranged between the fixed portion and the moving portion; and a shell having a second vent, the ventilation assembly being arranged in the shell, and the first vent and the second vent being arranged corresponding to each other, wherein at least one of the ventilation assembly and the shell is provided with a second sealing protrusion, and the second sealing protrusion is arranged between the ventilation assembly and the shell, wherein the second sealing protrusion is arranged to surround the first vent and the second vent.

2. The air-conditioning apparatus according to claim 1, wherein a top end of the second sealing protrusion is provided with a second elastic sealing piece, and the top end of the second sealing protrusion comprises an end away from the shell or the ventilation assembly to which the second sealing protrusion belongs.

3. The air-conditioning apparatus according to claim 1, wherein the first vent and the second vent are completely identical and aligned with each other.

4. The air-conditioning apparatus according to claim 1, wherein the first vent is smaller than the second vent, and the first vent is arranged in the second vent.

5. The air-conditioning apparatus according to claim 1, wherein the fixed portion is provided with the first sealing protrusion on at least one side of the opening.

6. The air-conditioning apparatus according to claim 5, wherein the fixed portion is provided with the first sealing protrusion on either side of the opening in a first direction, and the first sealing protrusion extends along a second direction, wherein the first direction is perpendicular to the second direction, and the limiting rail extends along the second direction.

7. The air-conditioning apparatus according to claim 5, wherein the fixed portion is provided with at least one annular first sealing protrusion around the opening.

8. The air-conditioning apparatus according to claim 5, wherein the moving portion is provided with at least one annular first sealing protrusion, and the at least one annular first sealing protrusion is configured to surround the opening when the moving portion is in a state of closing the opening.

9. The air-conditioning apparatus according to claim 1, wherein the moving portion is provided with at least one first sealing protrusion, the fixed portion is provided with at least one first sealing protrusion, and the at least one first sealing protrusion of the moving portion and the at least one first sealing protrusion of the fixed portion are configured to form at least one annular protrusion when the moving portion is in a state of closing the opening.

10. The air-conditioning apparatus according to claim 1, wherein a top end of the first sealing protrusion is provided with a first elastic sealing piece, and the top end of the first sealing protrusion comprises an end away from the fixed portion or the moving portion to which the first sealing protrusion belongs.

11. The air-conditioning apparatus according to claim 1, wherein the first vent of the volute is integrated with the fixed portion of the sealing mechanism.

* * * * *